US011920350B2

(12) United States Patent
Iftissen

(10) Patent No.: US 11,920,350 B2
(45) Date of Patent: Mar. 5, 2024

(54) DRAINAGE DEVICE EQUIPPED WITH AN ATTACHMENT SLEEVE FOR CONSTRUCTION, PARTICULARLY A BUILDING ROOF OR A TERRACE

(71) Applicant: Rikksen, Chalon sur Saone (FR)

(72) Inventor: M. Gérard Iftissen, Saint Martin d'Uriage (FR)

(73) Assignee: Rikksen, Chalon sur Saone (FR)

( * ) Notice: Subject to any disclaimer, the term of this patent is extended or adjusted under 35 U.S.C. 154(b) by 0 days.

(21) Appl. No.: 17/714,047

(22) Filed: Apr. 5, 2022

(65) Prior Publication Data

US 2022/0316215 A1 Oct. 6, 2022

(30) Foreign Application Priority Data

Apr. 6, 2021 (FR) ..... 2103503

(51) Int. Cl.
*E04D 13/04* (2006.01)

(52) U.S. Cl.
CPC .. *E04D 13/0409* (2013.01); *E04D 2013/0413* (2013.01); *E04D 2013/0436* (2013.01)

(58) Field of Classification Search
None
See application file for complete search history.

(56) References Cited

U.S. PATENT DOCUMENTS 402,600 A * 5/1889 Kemp ..... B65D 39/12 138/90
414,240 A * 11/1889 Norton ..... B63B 13/00 210/418
569,247 A * 10/1896 Smith ..... E03D 11/16 210/450

(Continued)

FOREIGN PATENT DOCUMENTS

CA 3116774 A1 * 4/2020 ..... E04D 13/0409
FR 3 087 461 A1 4/2020

(Continued)

OTHER PUBLICATIONS

Le Rapport de Recherche Préliminaire dated Oct. 7, 2021, issued in corresponding French Application No. 2103503, filed Apr. 6, 2021, 9 pages.

*Primary Examiner* — Robert J Popovics
(74) *Attorney, Agent, or Firm* — Christensen O'Connor Johnson Kindness PLLC

(57) ABSTRACT

A drainage device is provided. The drainage device includes a drainage head having at least one head portion having an internal collection space and provided with at least one through recovery passage, and an attachment sleeve at least partially deformable. The attachment sleeve can be secured to the drainage head and capable of being inserted inside the flow pipe. The drainage device further includes a compression washer attached on the attachment sleeve and a central screw. The central screw can be movable in relation to the drainage head and threadably engaged with the compression (Continued)

washer to obtain, under the effect of a rotation of the central screw relative to the drainage head, an axial movement of the compression washer on the side of the drainage head and an outward radial deformation of the attachment sleeve.

14 Claims, 6 Drawing Sheets

(56) References Cited

U.S. PATENT DOCUMENTS 689,624 A * 12/1901 Ryan ..... F16L 21/04 285/346
739,589 A * 9/1903 Clifford ..... F16L 55/136 220/237
853,598 A * 5/1907 Rile ..... E04D 13/0409 210/166
854,986 A * 5/1907 Weese ..... F24B 1/191 126/319
864,884 A * 9/1907 Capaldi ..... 4/219
926,704 A * 6/1909 Levy ..... 411/956
929,727 A * 8/1909 Sullivan ..... E03C 1/264 285/305
931,019 A * 8/1909 Dawes et al. ..... E03C 1/22 210/163
965,861 A * 8/1910 Berwanger ..... 4/219
969,776 A * 9/1910 Foley ..... E03B 9/10 70/168
1,195,827 A * 8/1916 Lucke ..... E03C 1/22 210/163
1,329,405 A * 2/1920 Hinton ..... E03F 7/04 210/163
1,434,254 A * 10/1922 Sanders ..... E04D 13/0409 210/163
1,469,303 A * 10/1923 Hess ..... E04D 13/0409 210/247
1,487,161 A * 3/1924 Holt ..... E04D 13/0409 285/348
1,494,882 A * 5/1924 Barger ..... E03C 1/264 4/292
1,538,924 A * 5/1925 Edward ..... E04D 13/0409 210/489
1,544,761 A * 7/1925 Kiefer ..... E04D 13/0409 285/47
1,618,679 A * 2/1927 Schifter ..... E03C 1/26 4/292
1,653,403 A * 12/1927 McCue ..... F16L 55/136 210/463
1,710,304 A * 4/1929 Flynn ..... E04D 13/0409 285/47
1,746,683 A * 2/1930 Schifter ..... E03C 1/262 4/287
1,753,262 A * 4/1930 Cromwell ..... E04D 13/0409 210/166
1,773,640 A * 8/1930 Prasivka ..... E03F 5/042 285/191
1,779,936 A * 10/1930 Hess ..... E04D 13/0409 285/263
1,791,512 A * 2/1931 Schurman ..... E04D 13/0409 210/166
1,918,509 A * 7/1933 Wilcox ..... E04D 13/0409 210/166
1,973,321 A * 9/1934 Schultz ..... E04D 13/0409 210/163
1,988,669 A * 1/1935 Sommerfeld ..... E04D 13/0409 210/166
1,999,277 A * 4/1935 Edward ..... E04D 13/0409 285/200
2,091,927 A * 8/1937 Hirshstein ..... E04D 13/0409 285/356
2,121,613 A * 6/1938 Schultz ..... E04D 13/0409 210/247
2,237,680 A * 4/1941 Mark ..... E03B 5/06 285/346
2,283,160 A * 5/1942 Edward ..... E04D 13/0409 210/163
2,283,365 A * 5/1942 Heinkel ..... E04D 13/0409 137/328
2,284,416 A * 5/1942 Gordon ..... E04D 13/0409 210/166
2,311,654 A * 2/1943 Filkins ..... E04D 13/0409 210/166
2,572,208 A * 10/1951 Sievert ..... E04D 13/0409 210/166
2,618,356 A * 11/1952 Matheis ..... E04D 13/0409 285/356
2,666,493 A * 1/1954 Gordon ..... E04D 13/0409 210/166
2,701,644 A * 2/1955 Griffiths ..... E04D 13/0409 210/477
2,740,490 A * 4/1956 Matheis ..... E04D 13/0409 210/166
2,773,554 A * 12/1956 Lindorf ..... E03F 5/042 138/90
2,800,231 A * 7/1957 Hicks ..... E03C 1/264 4/301
2,837,212 A * 6/1958 Schmid ..... E04D 13/0409 210/247
2,928,419 A * 3/1960 Kruse ..... E03F 5/042 285/191
3,045,830 A * 7/1962 Leota ..... B01D 24/045 210/450
3,082,606 A * 3/1963 Benjamin ..... A01G 25/16 285/308
3,095,219 A * 6/1963 Verne ..... E04D 13/0409 210/163
3,212,416 A * 10/1965 Boersma ..... E03F 5/06 210/163
3,287,742 A * 11/1966 Gaddis ..... E03C 1/26 285/191
3,291,156 A * 12/1966 Corsano ..... F16L 55/132 277/910
3,357,561 A * 12/1967 Schmid ..... E04D 13/0409 52/12
3,377,634 A * 4/1968 Patterson ..... A47L 19/04 4/290
3,378,858 A * 4/1968 Jacuzzi ..... E04H 4/1236 210/166
3,392,844 A * 7/1968 Decarie ..... E04D 13/0409 210/463
3,447,329 A * 6/1969 Emberson ..... E04D 13/0409 137/356
3,469,698 A * 9/1969 Louis ..... E04D 13/0409 52/12
3,469,699 A * 9/1969 Louis ..... E04D 13/0409 210/166
3,517,813 A * 6/1970 Kunibert ..... E04D 13/0409 210/166
3,529,723 A * 9/1970 Hagedorn ..... E04D 13/0409 210/163
3,667,611 A * 6/1972 Pansini ..... E04H 4/1236 210/473
3,674,149 A * 7/1972 Donalson ..... E03F 5/0407 210/163
3,722,532 A * 3/1973 Ebeling ..... E04D 13/0409 137/357
3,747,541 A * 7/1973 Reese ..... E05G 1/00 70/230
3,757,812 A * 9/1973 Duncan ..... F04D 29/586 137/142
3,884,809 A * 5/1975 Logsdon ..... E04D 13/0409 210/163
3,893,919 A * 7/1975 Flegel ..... E04D 13/0409 210/166
3,909,412 A * 9/1975 Patry ..... E04D 13/0409 210/166
3,911,635 A * 10/1975 Traupe ..... H02G 3/121 52/220.1

(56) References Cited

U.S. PATENT DOCUMENTS 4,035,297 A * 7/1977 Aldridge ..... E04D 13/0409 251/339
4,107,929 A * 8/1978 Ebeling ..... E04D 13/0409 52/12
4,112,691 A * 9/1978 Ebeling ..... E04D 13/0409 52/12
4,180,094 A * 12/1979 Viragh ..... E03F 5/12 4/295
D256,948 S * 9/1980 Boersma ..... D23/308
4,257,892 A * 3/1981 Boersma ..... E03C 1/26 210/163
4,303,101 A * 12/1981 Tholen ..... F16L 55/132 220/237
4,400,272 A * 8/1983 Logsdon ..... E04D 13/0409 210/166
4,455,693 A * 6/1984 Cuschera ..... E03F 5/0401 277/621
4,487,690 A * 12/1984 Logsdon ..... E04D 13/0409 405/36
4,492,491 A * 1/1985 Lunden ..... E04D 13/0409 52/12
4,505,499 A * 3/1985 Uglow ..... E04D 13/0409 285/346
4,505,814 A * 3/1985 Marshall ..... E04D 13/0409 404/26
4,525,273 A * 6/1985 Logsdon ..... E04D 13/0409 210/166
4,585,033 A * 4/1986 Westman ..... F16L 55/132 138/89
4,592,676 A * 6/1986 Gilgen ..... E04D 13/0409 405/36
4,652,365 A * 3/1987 Ebeling ..... E04D 13/0409 52/12
4,655,913 A * 4/1987 Boersma ..... E03C 1/264 210/163
4,683,685 A * 8/1987 Ebeling ..... E04D 13/0409 52/12
4,753,461 A * 6/1988 Miller ..... F16L 21/007 285/341
4,759,163 A * 7/1988 Mason ..... E04D 13/0409 52/58
4,799,713 A * 1/1989 Uglow ..... E04D 13/0409 210/163
4,850,617 A * 7/1989 Moberly ..... E03C 1/20 285/137.11
4,871,451 A * 10/1989 Piskula ..... E03F 5/0407 52/12
4,961,848 A * 10/1990 Logsdon ..... E04D 13/0409 210/166
4,968,197 A * 11/1990 Chen ..... F16L 55/132 138/90
4,982,764 A * 1/1991 Saxon ..... F16L 55/132 166/187
5,035,265 A * 7/1991 Chen ..... F16L 55/132 138/89
5,044,403 A * 9/1991 Chen ..... F16L 55/132 220/236
5,054,956 A * 10/1991 Huang ..... E02D 29/1409 404/26
5,071,177 A * 12/1991 Spiess ..... E05C 3/042 292/214
5,141,633 A * 8/1992 Walczak ..... E04D 13/0409 210/232
5,150,927 A * 9/1992 Skinner ..... F16L 5/10 277/606
5,209,522 A * 5/1993 Reaux ..... F16L 23/18 285/123.7
5,234,582 A * 8/1993 Savoie ..... E04D 13/0409 52/12
5,297,817 A * 3/1994 Hodges ..... F16L 23/024 285/15
5,297,895 A * 3/1994 Johnson ..... E02B 11/00 405/74
5,378,356 A * 1/1995 Logsdon ..... E04D 13/0409 210/166
5,394,657 A * 3/1995 Peterson ..... F04F 5/54 52/302.1
5,469,670 A * 11/1995 Thaler ..... E04D 13/0409 52/12
5,522,197 A * 6/1996 Ebeling ..... E04D 13/0409 52/302.1
5,526,613 A * 6/1996 Simeone, Jr. ..... E04D 13/0409 52/302.1
5,582,720 A * 12/1996 Deming ..... E03F 5/0401 210/164
5,618,416 A * 4/1997 Haefner ..... E04D 13/0409 210/166
5,650,065 A * 7/1997 Sewell ..... E03F 5/16 52/12
5,689,928 A * 11/1997 Rasksen ..... E04D 13/0409 52/302.1
5,695,222 A * 12/1997 Hodges ..... E03D 11/16 285/15
5,724,777 A * 3/1998 Hubbard ..... E04D 13/0409 52/302.1
5,733,444 A * 3/1998 Johnson ..... E03F 5/0404 210/232
5,735,091 A * 4/1998 Hawkins ..... E04D 13/0409 52/302.1
5,744,048 A * 4/1998 Stetler ..... E03F 5/0401 210/232
5,797,431 A * 8/1998 Adams ..... F16L 55/136 138/93
5,843,306 A * 12/1998 Singleton ..... B01D 29/15 210/170.03
5,918,638 A * 7/1999 Davis ..... F16L 55/1283 138/90
5,966,884 A * 10/1999 Uglow ..... E04D 13/0409 52/302.1
6,004,457 A * 12/1999 Singleton ..... E03F 5/0401 210/170.03
6,092,244 A * 7/2000 Rizzardi ..... E03F 5/06 4/293
6,165,357 A * 12/2000 Cormier ..... E04D 13/0409 52/12
6,168,208 B1 * 1/2001 Thaler ..... E04D 13/0409 285/110
6,261,445 B1 * 7/2001 Singleton ..... E03F 5/04 210/170.03
D446,844 S * 8/2001 Claussen ..... D23/261
6,318,397 B1 * 11/2001 Huber ..... F16K 15/16 137/856
6,330,724 B1 * 12/2001 Belle ..... E03F 5/06 4/286
6,360,379 B1 * 3/2002 Lane ..... E04H 4/1236 210/163
6,416,674 B1 * 7/2002 Singleton ..... E03F 5/105 210/170.03
6,428,693 B2 * 8/2002 Singleton ..... E03F 5/0404 210/170.03
6,453,603 B1 * 9/2002 Baker ..... A01M 1/2011 43/132.1
6,594,966 B2 * 7/2003 Froeter ..... E04D 13/0409 52/302.1
6,609,852 B2 * 8/2003 Wimberger ..... E03F 1/00 210/170.03
6,631,588 B1 * 10/2003 Distler ..... E04D 13/0409 52/302.1
6,647,682 B2 * 11/2003 Bishop ..... E04D 13/0409 52/302.1
6,817,043 B2 * 11/2004 Zars ..... E04H 4/1236 4/292
6,833,067 B2 * 12/2004 Dresmann ..... E04D 13/0409 52/302.1
7,005,061 B1 * 2/2006 Downs ..... E03F 1/00 210/474

(56) References Cited

U.S. PATENT DOCUMENTS 7,052,207 B1 * 5/2006 Wimberger ..... E03F 5/0401 210/170.03
7,278,450 B1 * 10/2007 Condon ..... F16L 55/1108 285/348
7,300,573 B1 * 11/2007 Trangsrud ..... E03F 1/00 210/474
7,396,471 B2 * 7/2008 Wimberger ..... E03F 5/0401 210/170.03
7,407,574 B2 * 8/2008 Robinson ..... E04D 13/0767 52/12
7,415,802 B2 * 8/2008 Froeter ..... E04D 13/0409 52/302.1
D578,619 S * 10/2008 Rattenbury ..... D23/261
D598,523 S * 8/2009 McAlpine ..... D23/268
D598,987 S * 8/2009 McAlpine ..... D23/268
7,591,111 B2 * 9/2009 Froeter ..... E04D 13/0409 52/302.1
7,600,644 B2 * 10/2009 McCallum ..... E03F 5/0404 210/450
7,614,198 B1 * 11/2009 Piskula ..... E04D 13/0409 52/302.1
7,784,242 B2 * 8/2010 Warnecke ..... E04D 13/0409 52/302.1
8,158,010 B2 * 4/2012 Pearse ..... E03F 5/125 210/799
8,246,430 B1 * 8/2012 Paynton ..... F23J 13/08 454/44
8,496,822 B2 * 7/2013 Schoell ..... E04D 13/0409 52/12
8,557,108 B2 * 10/2013 Rennels ..... E03C 1/264 210/163
8,557,109 B1 * 10/2013 Sutherland ..... E03F 5/0404 210/163
8,578,523 B2 * 11/2013 Eichler ..... E03F 5/02 4/286
8,628,657 B1 * 1/2014 Robillard ..... B01D 35/02 52/302.1
8,679,328 B2 * 3/2014 Hebert ..... E03F 5/0404 210/163
8,834,714 B2 * 9/2014 Chien ..... E03F 1/00 210/166
8,894,850 B2 * 11/2014 Coscarella ..... E03F 5/06 210/232
D726,886 S * 4/2015 Sutherland ..... D23/261
9,015,870 B2 * 4/2015 Ball ..... E03C 1/22 4/286
9,015,876 B2 * 4/2015 Ball ..... E03C 1/22 285/46
9,175,797 B1 * 11/2015 Behoteguy ..... E03F 5/0411
9,422,708 B2 * 8/2016 Hull ..... E03F 5/041
9,518,389 B1 * 12/2016 McDanal ..... E04D 13/0409
9,637,928 B2 * 5/2017 Liptak ..... E04D 13/0409
9,920,533 B2 * 3/2018 Johnsen ..... E04D 13/0409
10,113,303 B2 * 10/2018 Mardian ..... E03F 5/06
10,465,370 B2 * 11/2019 Donnelly ..... F16L 5/027
10,487,492 B2 * 11/2019 Boersma ..... E03C 1/26
10,676,930 B2 * 6/2020 West ..... E04D 13/0409
10,822,785 B1 * 11/2020 Berry ..... E03F 5/0404
10,907,356 B2 * 2/2021 Mechler ..... E03F 5/06
10,961,714 B2 * 3/2021 Herrero-Smith .... E04D 13/0409
11,008,748 B1 * 5/2021 Hodge, Jr. ..... E03F 5/06
11,293,171 B2 * 4/2022 Berry ..... E04D 13/0409
11,441,305 B1 * 9/2022 Alhazza ..... B01D 29/6476
11,447,943 B2 * 9/2022 Donnelly ..... F16L 27/1275
11,708,690 B2 * 7/2023 Singleton ..... E03F 5/14 210/166
2003/0037498 A1 * 2/2003 Bishop ..... E04D 13/0409 52/302.1
2003/0084631 A1 * 5/2003 Froeter ..... E04F 17/00 52/302.1
2003/0141231 A1 * 7/2003 Rattenbury ..... E04D 13/0409 210/163
2003/0201217 A1 * 10/2003 Dresmann ..... E04D 13/0409 210/163
2005/0178073 A1 * 8/2005 Froeter ..... E04D 13/0409 52/12
2006/0283792 A1 * 12/2006 McCallum ..... E03F 1/00 210/163
2007/0277447 A1 * 12/2007 Sommerhein ..... E04D 13/0409 52/11
2008/0237100 A1 * 10/2008 Wimberger ..... E03F 5/0401 210/163
2011/0120924 A1 * 5/2011 Coscarella ..... E03F 5/06 210/164
2011/0168711 A1 * 7/2011 Coscarella ..... E03F 5/06 220/315
2011/0253641 A1 * 10/2011 Pearse ..... E03F 5/125 210/232
2011/0278835 A1 * 11/2011 Kishi ..... F16L 21/02 285/348
2014/0158593 A1 * 6/2014 Chien ..... E03F 1/00 210/166
2014/0265158 A1 * 9/2014 Liptak ..... E04D 13/0409 277/616
2015/0115596 A1 * 4/2015 Donnelly ..... F16L 5/12 285/42
2016/0153195 A1 * 6/2016 Johnsen ..... E04D 13/0409 52/302.1
2018/0080484 A1 * 3/2018 Venkatesan ..... E04D 13/0767
2021/0348390 A1 * 11/2021 Iftissen ..... E04D 13/0409
2022/0316215 A1 * 10/2022 Iftissen ..... E04D 13/0409
2023/0228087 A1 * 7/2023 Majocka ..... E04D 13/0409 285/42

FOREIGN PATENT DOCUMENTS

FR 3121461 A1 * 10/2022 ..... E04D 13/0409
JP 2016-79566 A 5/2016

* cited by examiner

DRAINAGE DEVICE EQUIPPED WITH AN ATTACHMENT SLEEVE FOR CONSTRUCTION, PARTICULARLY A BUILDING ROOF OR A TERRACE

TECHNICAL FIELD

The present invention relates to the field of drainage devices used for the removal of rainwater accumulating on construction walls, in particular building roofs and terraces.

BACKGROUND

Generally, the roofs of buildings, particularly the flat roof slabs, and terraces have rainwater flow pipes that direct it towards a drainage system via channeling.

In particular to prevent the drainage system from becoming blocked and from overflowing, it is known to equip the roofs and terraces with protruding drainage devices that surround these flow pipes and that have recovery passages so that the flow rate of the rainwater removed towards the flow pipes is limited.

SUMMARY

The aim of the present invention is to propose a drainage device that is easy to manufacture and install.

The invention relates to a drainage device intended to be installed on a construction provided with a flow pipe, in particular on a roof of a building or a terrace in view of removing rainwater.

The drainage device comprises a drainage head internally delimiting a collection space and provided with at least one through recovery passage, and an attachment sleeve at least partially deformable, secured to the drainage head and capable of being engaged inside the flow pipe.

"Attachment sleeve secured to the drainage head" means that the sleeve is indirectly attached to the drainage head by means of at least one part, or that the sleeve is directly attached on the drainage head.

The drainage device also comprises a compression washer attached on the attachment sleeve, and a stressing element movable in relation to the drainage head and cooperating with the compression washer to obtain, under the effect of a movement of said stressing element relative to the drainage head, an axial movement of the compression washer on the side of the drainage head and an outward radial deformation of the attachment sleeve.

The attachment of the drainage device to the flow pipe of the construction may thus be performed by actuation of the stressing element that makes it possible to obtain the outward radial deformation of the attachment sleeve until it comes to press and crush against the bore of the flow pipe. The axial movement of the compression washer causes the tightening and the pinching of the attachment sleeve between it and the drainage head.

The locking of the drainage device is obtained by jamming the attachment sleeve against the flow pipe.

Furthermore, given the deformable character of the attachment sleeve, the drainage device may be installed on drainage pipes having different diameters. The attachment sleeve moreover makes it possible to ensure a sealing function with the flow pipe.

In a preferred embodiment, the stressing element cooperates by screwing with the compression washer. The stressing element may for example comprise at least one screw or one rod engaged with the compression washer. In this case, the stressing element is rotatable in relation to the drainage head.

Alternatively, it may be possible to provide a translational movement of the stressing element relative to the drainage head in order to obtain the radial deformation of the attachment sleeve. In this case, the device should be equipped with means for locking in position the stressing element in the deformed position of the sleeve.

In another embodiment, it may also be possible to provide that the stressing element is rotatable and movable in translation relative to the drainage head.

In one embodiment, the stressing element extends partially inside the drainage head, and connects the drainage head and the compression washer. The stressing element may for example comprise a screw or a central rod engaged with the compression washer.

Advantageously, the stressing element extends axially and is accessible from the outside of the drainage head. Preferably, the stressing element extends axially protruding in relation to an upper front face of the drainage head.

The compression washer may be attached to an axial end of the attachment sleeve that is axially oriented on the side opposite the drainage head. Alternatively, the compression washer may be attached at a distance from this axial end.

The attachment sleeve may partially surround the drainage head. The attachment sleeve has, in rest position, an external diameter less than the internal diameter of the flow pipe.

Preferably, the compression washer is provided with at least one through recess for the passage of rainwater.

In a particular embodiment, the device further comprises a mounting washer attached on the drainage head and on which the attachment sleeve is attached.

The mounting washer may be attached to an axial end of the attachment sleeve axially oriented on the side of the drainage head. Alternatively, the mounting washer may be attached at a distance from this axial end.

As indicated above, the stressing element may extend partially inside the drainage head. In another embodiment, the stressing element is entirely located outside of the drainage head. In this case, the stressing element may comprise a plurality of screws spaced one in relation to another in the circumferential direction, extending through the mounting washer and engaging with the compression washer in order to obtain a deformation of the attachment sleeve during the rotation of the screws. In this case, the sleeve extends axially between the mounting and compression washers.

In another particular embodiment, the attachment sleeve may be directly attached on the drainage head without interposition of the mounting washer.

The drainage head may comprise at least one head portion internally delimiting the collection space and provided with said through recovery passage, and a shoulder axially delimiting the head portion.

Preferably, the attachment sleeve extends entirely on the side opposite the collection space of the head portion in relation to the shoulder.

In one embodiment, the drainage head further comprises a drainage pipe, the shoulder being formed between the drainage pipe and the head portion.

In this case, the attachment sleeve may be secured to the drainage pipe.

Alternatively, irrespective of the presence or not of the drainage pipe, the attachment sleeve may be secured to the shoulder.

In one embodiment, the drainage device may further comprise a seal mounted around the drainage pipe and axially disposed between the shoulder of the drainage head and the attachment sleeve. The seal may be axially interposed between the shoulder of the drainage head and the mounting washer.

Preferably, the attachment sleeve is entirely deformable. The attachment sleeve may be made at least partially of deformable material, particularly of an elastically deformable material. The compression washer, and the mounting washer when it is provided, may be made at least partially of a rigid material.

Advantageously, the attachment sleeve has a tubular shape. Preferably, the attachment sleeve is devoid of through opening arranged in its thickness. Alternatively, it is however possible to provide such opening(s).

DESCRIPTION OF THE DRAWINGS

The present invention will be better understood upon reading the detailed description of embodiments taken by way of non-limiting examples and illustrated in the appended drawings wherein.

DETAILED DESCRIPTION

Figure 1:
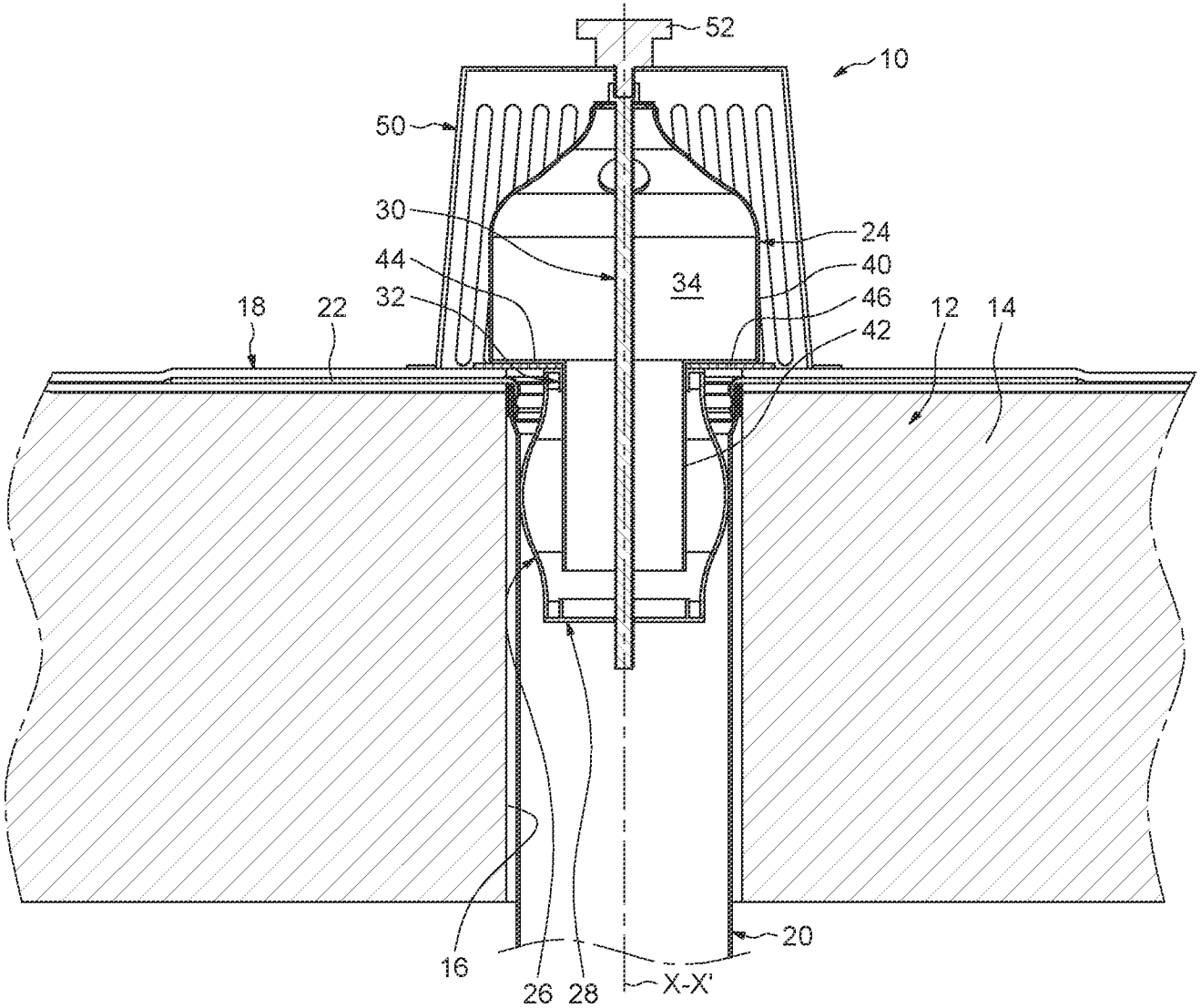
FIG. 1 is an axial sectional view of a drainage device according to one embodiment of the invention, in position installed on the slab of a building.

FIG. 1 shows a drainage device 10 that is installed on a construction 12 comprising a slab 14 of a flat or sloping roof, in the aim of removing water that is above this slab. A hole 16 is arranged through the slab 14 that comprises a waterproof covering 18 on the outside.

The drainage device 10 is assembled with a flow pipe 20 of the construction that is disposed through the vertical hole 16. In FIG. 1, the device 10 and the flow pipe 20 are shown in position presumed vertical. The flow pipe 20 is equipped with a membrane 22 that is covered by the waterproof covering 18. The flow pipe 20 is intended to remove rainwater accumulating on the slab 14 on the outside.

The drainage device 10 comprises a drainage head 24, of axis X-X, an attachment sleeve 26 secured to the drainage head, a compression washer 28 or plate attached on the attachment sleeve, and a screw 30 extending into the drainage head and engaging with the compression washer 28.

As will be described in more detail subsequently, the rotation of the screw 30 makes it possible, by means of the compression washer 28, to stress the attachment sleeve 26 and obtain its outward radial deformation.

In the example of embodiment illustrated, the drainage device 10 also comprises a mounting washer 32 or plate to ensure the attachment of the attachment sleeve 26 on the drainage head 24.

The drainage head 24 internally delimits a rainwater collection space 34 that is intended to communicate with the outside and with the flow pipe 20.

Figure 2:
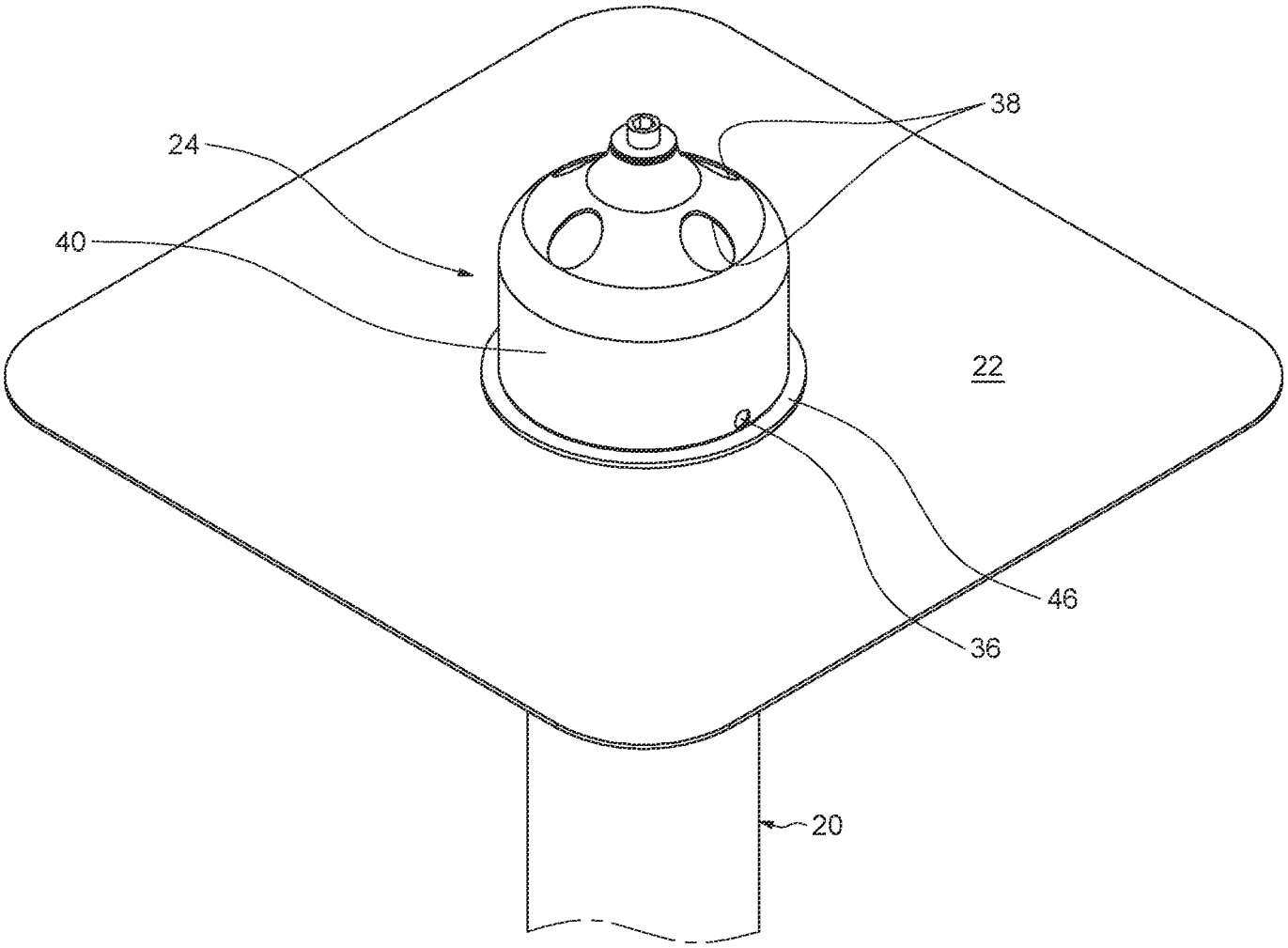
FIG. 2 is a perspective view of the drainage device of FIG. 1 assembled with a flow pipe.

The drainage head 24 is provided with water recovery passages 36, 38 (FIG. 2) that are provided to allow water to enter, which is around the head above the slab 14, in the collection space 34, so that the water is removed by the flow pipe 20 from this space. The recovery passages 36, 38 pass through the thickness of the drainage head.

In the example of embodiment illustrated, the drainage head 24 comprises a lower through recovery passage 36, and a plurality of upper recovery passages 38 that are vertically offset above the recovery passage 36. The lower recovery passage 36 is arranged on the drainage head 24 so as to be located in the vicinity of the membrane 22 of the flow pipe. The upper recovery passages 38 are located here in the vicinity of the upper end of the drainage head 24. The upper recovery passages 38 have a passage section greater than that of the lower recovery passage 36. As a variant, the drainage head 24 may be provided with a plurality of lower recovery passages 36 disposed or not at the same height. In another variant, the drainage head 24 may be provided with a single through recovery passage.

Referring again to FIG. 1, the drainage head 24 comprises a head portion 40 and a drainage pipe 42 axially extending the head portion 40. An annular radial shoulder 44 is formed between the drainage pipe 42 and the head portion 40. The head portion 40 and the drainage pipe 42 are axially disposed on either side of the radial shoulder 44. The drainage pipe 42 extends here from the shoulder 44 on the side opposite the head portion 40. The shoulder 44 is formed by the difference of diameter between the head portion 40 and the drainage pipe 42. In the example of embodiment illustrated, the head portion 40 has a bell shape.

The purpose of the radial shoulder 44 is to perform the positioning of the drainage head 24 in relation to the slab 14. The head portion 40 of the drainage head is located above the slab 14, and the drainage pipe 42 extends inside its hole 16 and engages without contact in the flow pipe 20.

The head portion 40 of the drainage head internally delimits the collection space 34. The recovery passages 36, 38 (FIG. 2) of the drainage head 24 are arranged on the head portion 40. The drainage pipe 42 is in direct communication with the collection space 34.

When water is around the drainage head 24 of the device above the slab 14, it flows through the lower recovery passage 36 towards the collection space 34, then from this space to the inside of the drainage pipe 42 and of the flow pipe 20. If the flow rate of the water through the lower recovery passage 36 is insufficient given precipitations, the water level above the slab 14 rises until reaching the upper recovery passages 38 that ensure the overflow of the water into the collection space 34 then the removal by the drainage pipe 42 and the flow pipe 20, at a flow rate greater than that which is possible by the lower recovery passage 36.

In the example of embodiment illustrated, the drainage head 24 is made of a single part. As a variant, the head portion 40 and the drainage pipe 42 may be formed by two different parts assembled with one another. The drainage head 24 may be made of metal material, for example sheet metal.

The attachment sleeve 26, of axis is mounted on the drainage head 24. The attachment sleeve 26 is mounted on the drainage pipe 42 of the drainage head.

As indicated above, in this example, the mounting washer 32 is provided to ensure the attachment of the attachment sleeve 26 on the drainage head 24. The attachment sleeve 26 is attached on the washer 32 that itself is attached on the drainage head 24. An axial end of the attachment sleeve 26 is attached on the drainage head 24, the other axial end of the sleeve being free in relation to the drainage head.

Figure 3:
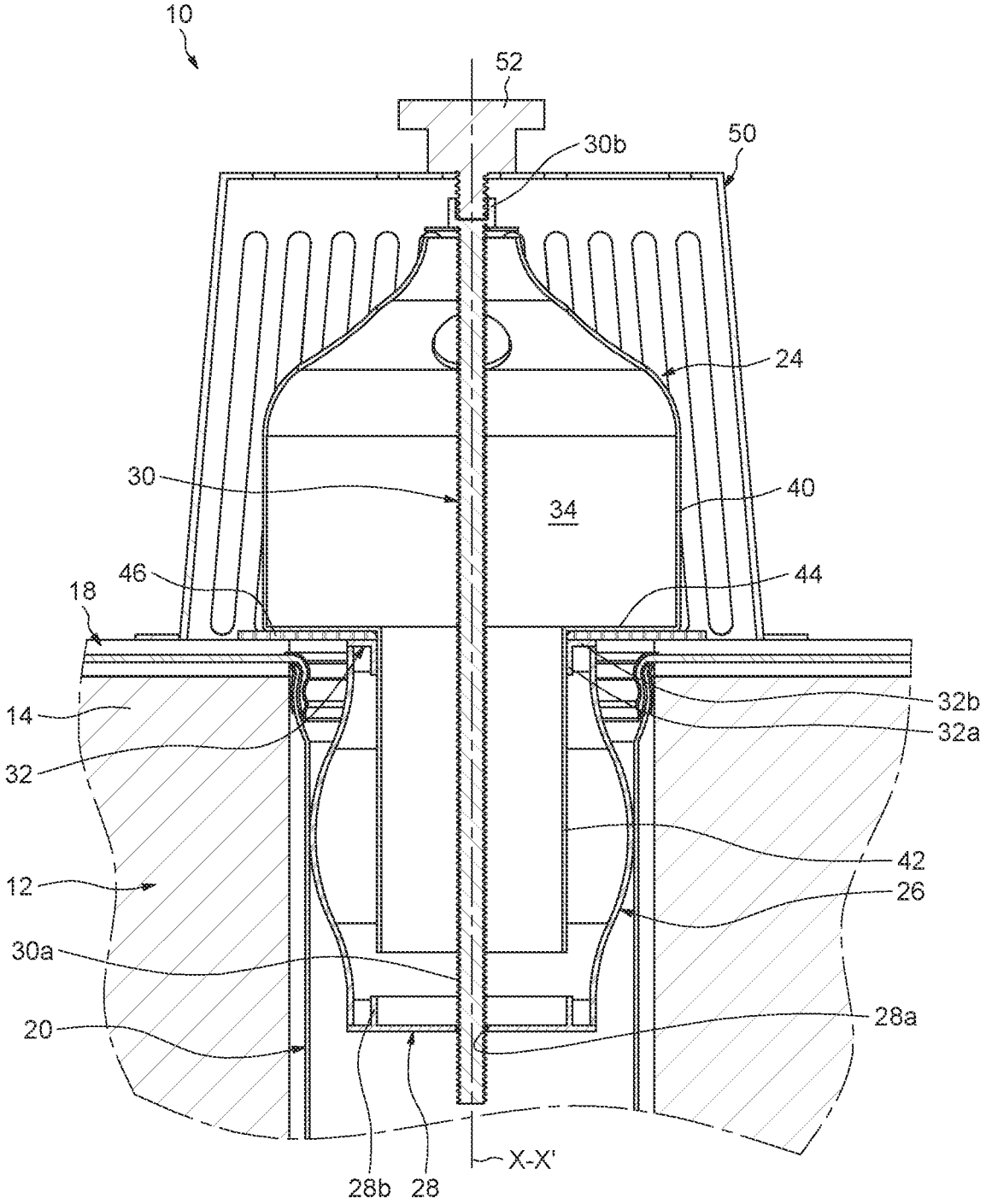
FIG. 3 is a detail view of FIG. 1.

As illustrated more visibly in FIG. 3, the mounting washer 32 is attached on the drainage pipe 42 of the drainage head. The mounting washer 32 is attached on the drainage pipe 42 by any suitable means, for example by tight fitting.

The mounting washer 32 comprises an annular attachment base 32*a* attached on the drainage pipe 42 of the drainage head, and an annular flange 32*b* extending outwards the base 32*a*. The flange 32*b* extends radially outwards an axial end of the base 32*a*. The mounting washer 32 may for example be made of metal material or also of rigid plastic material or of rigid rubber.

The axial end of the attachment sleeve 26 that is axially oriented on the side of the head portion 40 of the drainage head is attached to the mounting washer 32. The attachment sleeve 26 is attached on the flange 32*h* of the mounting washer. The attachment sleeve 26 is attached on the mounting washer 32 by any suitable means, for example by gluing, by mechanical attaching, by overmolding, by heat sealing etc.

The device 10 also comprises a seal 46 mounted around the drainage pipe 42 of the drainage head and axially interposed between the shoulder 44 of the drainage head and the mounting washer 32. The seal 46 is of annular shape and centered on the axis X-X'. The seal 46 axially presses against the outer surface of the slab of the building, here the waterproof covering 18. The seal 46 may for example be made of elastomer, particularly of rubber.

The compression washer 28 is attached on the attachment sleeve axially opposite the mounting washer 32. The compression washer 28 is attached to the axial end of the attachment sleeve 26 that is axially oriented on the side opposite the drainage head 24.

Figure 4:
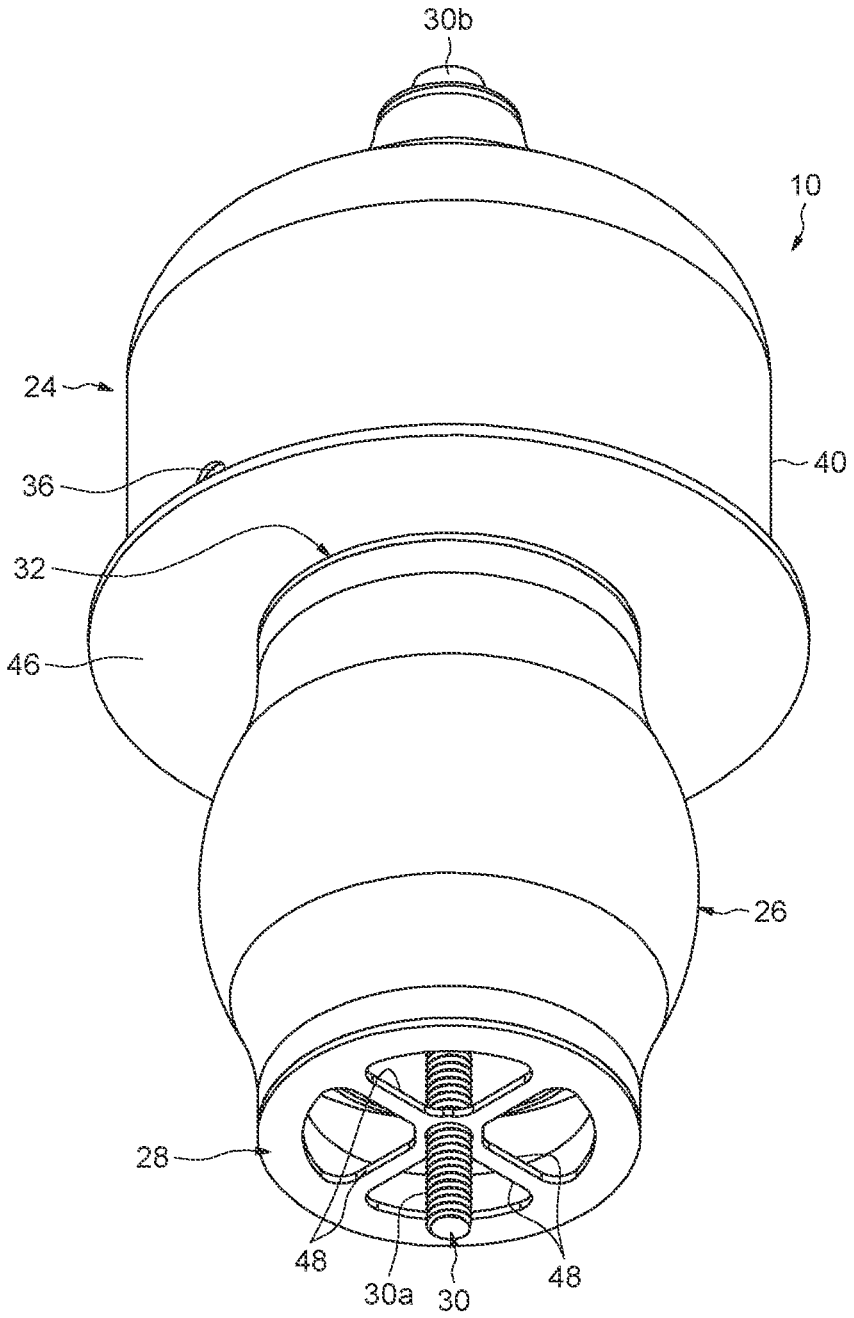
FIG. 4 is a perspective view of the drainage device of FIG. 1, FIG. 5 and FIG. 6 are axial sectional views illustrating the assembly of the drainage device of FIG. 1.

The compression washer 28 is provided with a plurality of through recesses 48 (FIG. 4) for the passage of rainwater. The recesses 48 pass through the axial thickness of the washer 28. The compression washer 28 is equipped with a threaded bore 28*a*. The bore 28*a* is centered on the axis X-X'. The compression washer 28 may for example be made of metal material or also of rigid plastic material or of rigid rubber.

The attachment sleeve 26 is attached on the compression washer 28 any suitable means, for example by gluing, by mechanical attaching, by overmolding, by heat sealing, etc.

The attachment sleeve 26 is here in the form of a tubular sheath. The attachment sleeve 26 radially surrounds the drainage pipe 42 of the drainage head. The attachment sleeve 26 remains radially at a distance from the drainage pipe 42. The attachment sleeve 26 extends axially beyond the drainage pipe 42. The attachment sleeve 26 is deformable. Preferably, the attachment sleeve 26 is made in a deformable material, particularly in an elastically deformable material. The attachment sleeve 26 may for example be made of elastomer, particularly of EPDM, or also of silicone, of flexible polyurethane, of rubber, etc.

In the example of embodiment illustrated, the attachment sleeve 26 is manufactured separately from the compression 28 and mounting washers 32 before assembly to obtain a single unit. Alternatively, it is possible to manufacture the attachment sleeve 26 and the washers 28, 32 by bi-injection of a deformable material for the sleeve and of a rigid material for the washer 28, 32.

As will be described in more detail subsequently, the attachment sleeve 26 is capable of ensuring the attachment of the device 10 relative to the flow pipe 20 by deformation and contact of the attachment sleeve against it.

The screw 30, of axis X-X', connects the drainage head 24 and the attachment sleeve 26. The screw 30 extends axially inside the drainage head 24 and protruding in relation to it on the side of the compression washer 28 and of the attachment sleeve 26. The screw 30 extends axially inside the drainage pipe 42 of the drainage head. The screw 30 is engaged with the threaded bore 28*a* of the compression washer. The outer surface of the screw 30 comprises to this effect an outer threading 30*a*. The screw 30 is in the form of a rod.

The screw 30 extends axially through the head portion 40 of the drainage head. The screw 30 is accessible from the outside. The screw 30 extends axially protruding in relation to an upper front face of the drainage head 40, The screw comprises a head 30*b* that is located outside of the head portion 40 and axially pressing against it.

In installed position as is illustrated in FIGS. 1 and 3, the attachment sleeve 26 presses in the radial direction against the bore or inner wall of the flow pipe 20, and makes it possible to axially hold the seal 46 of the drainage device pressing against the slab 14.

Figure 5:
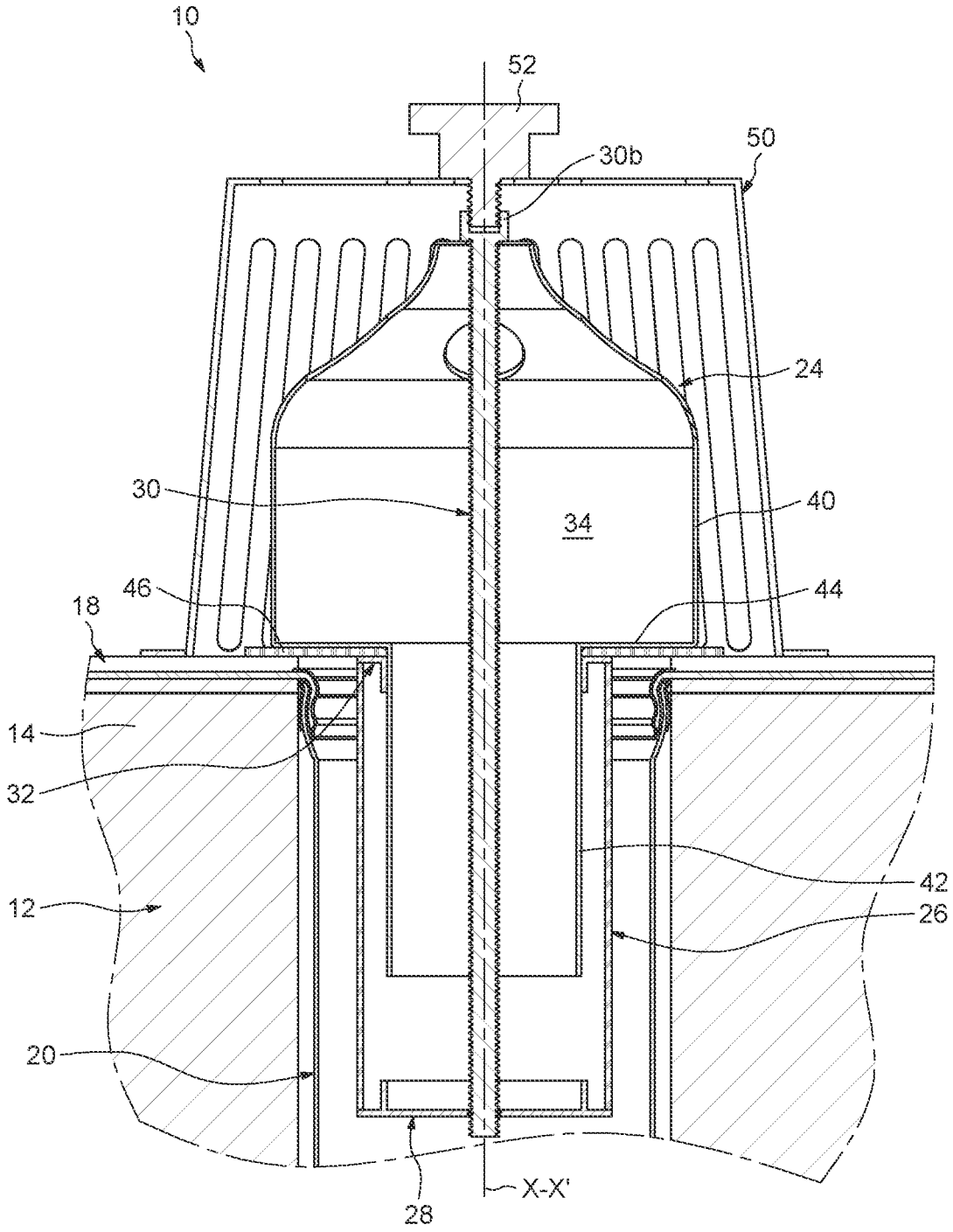

As illustrated in FIG. 5, in its non-deformed or rest position, the attachment sleeve 26 has an external diameter less than that in the deformed state and that is less than the internal diameter of the flow pipe 20.

The installation of the device 10 may be performed in the following way.

In a first step, the drainage head 24 is installed on the construction 12 by inserting its drainage pipe 42 and the attachment sleeve 26 in the non-deformed state inside the flow pipe 20, and by bringing the seal 46 axially pressing against the slab 14 as is illustrated in FIG. 5. The drainage head 24 and the attachment sleeve 26 are inserted from top to bottom into the flow pipe 20.

During this insertion, there is no contact in the radial direction between the attachment sleeve 26 of the device and the flow pipe 20 equipping the slab 14.

Figure 6:
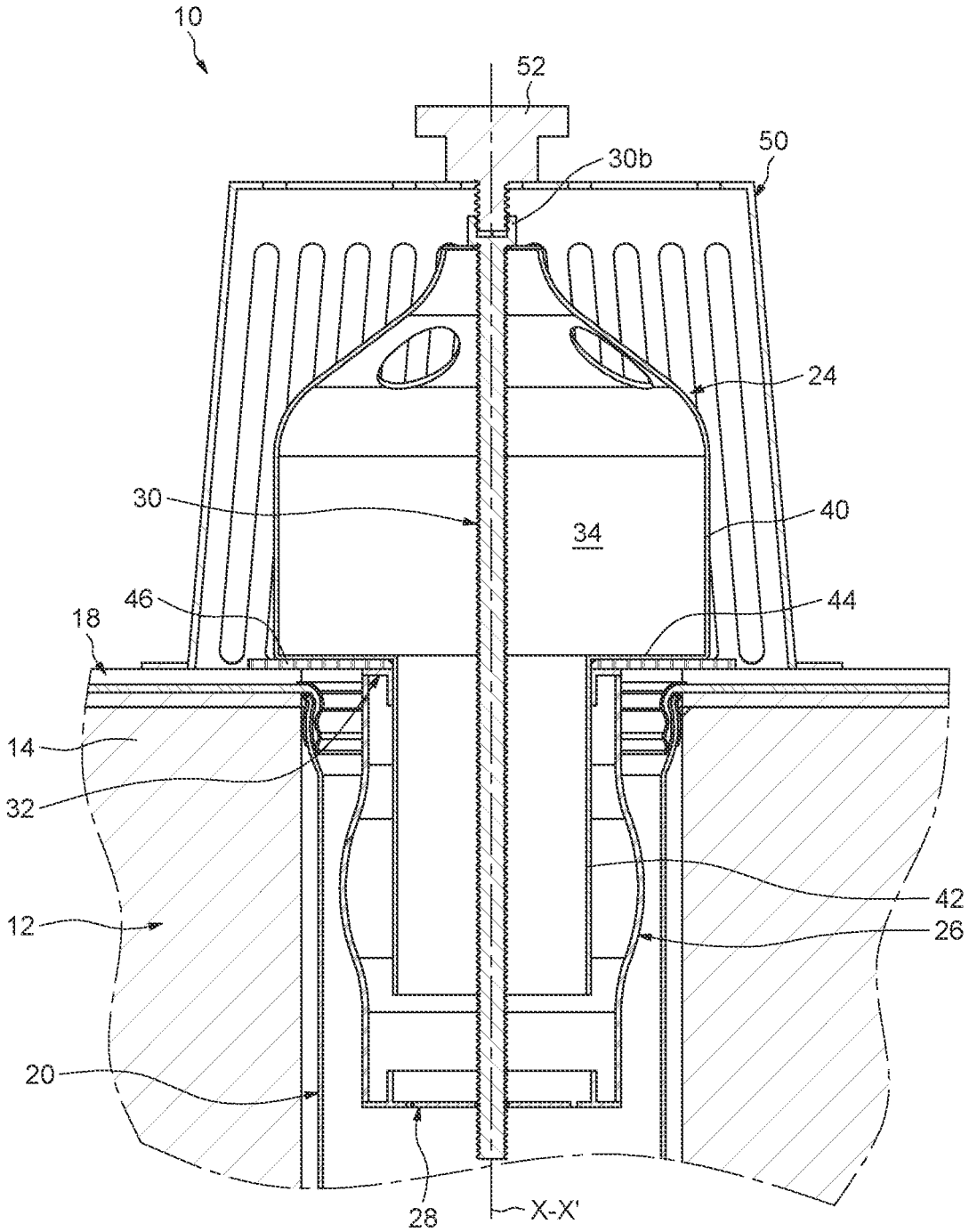

Then, in a second step, the screw 30 is rotated by means of the head 30*b* so as to axially bring the compression washer 28 closer towards the drainage head 24. The axial rise of the compression washer 28 along the screw 30 causes the outward radial deformation of the attachment sleeve 26 in the direction of the flow pipe 20 as is illustrated in FIG. 6. Indeed, the axial movement of the compression washer 28 that is attached to the attachment sleeve 26 has the effect of outwardly radially constraining it. The level of radial deformation of the attachment sleeve 26 is defined by the axial position of the compression washer 28.

The screw 30 will continue to be rotated until the axial rise of the compression washer 28 is sufficient to bring the attachment sleeve 26 in contact against the bore of the flow pipe 20 as illustrated in FIGS. 1 and 3.

The radial contact between the outer surface of the attachment sleeve 26 and the bore of the flow pipe 20 makes it possible to ensure the attachment of the device 10 by jamming. The attachment sleeve 26 is tightened against the flow pipe 20.

Once the radial deformation of the attachment sleeve 26 by the compression washer 28 is sufficient to obtain the locking of the device 10, if the rotation of the screw 30 is continued, this also accentuates the deformation of the attachment sleeve 26 and axially compresses the seal 46 between the slab 14 and the shoulder 44 of the drainage head. This makes it possible to ensure a good axial pinning of the seal 46 and of the drainage head 24 against the slab 14.

In the example of embodiment illustrated, in the assembled position of the device 10 with the flow pipe 20, the compression washer 28 remains axially at a distance from the drainage pipe 42 of the drainage head. According to the internal diameter of the flow pipe 20 and the degree of deformation needed of the attachment sleeve 26 to obtain the jamming of the device 10, in the assembled position, it is possible that the compression washer 28 is axially pressing against the drainage pipe 42. The compression washer 28 is equipped with a centering flange 28*b* that is capable of engaging around the flow pipe 20 in this case.

As seen particularly in FIG. 1, the device 10 also comprises a perforated cover 50 that surrounds at a distance the head portion 40 of the drainage head 24. The cover 50 is mounted pressing against the slab 14. The cover 50 is secured thanks to a through handle 52 that comes to screw on the head 30*b* of the screw. The cover 50 and the handle 52 are preferably installed before assembling the attachment sleeve 26 and the drainage head 24 with the flow pipe 20. In this case, the handle 52 may serve as member for actuating the screw 30. Alternatively, it is possible to install the cover 50 and the handle 52 after assembling the attachment sleeve 26 and the drainage head 24 with the flow pipe 20

In the example of embodiment illustrated, the device 10 is installed on a vertical flow pipe 20. The device 10 may be installed on an obliquely inclined flow pipe 20. In this case, the shape of the head portion 40 of the drainage head and the location of the water recovery passages 36, 38 may be adapted.

The invention claimed is:

1. A drainage device for installation on a construction slab provided with an open drainage flow pipe, the drainage device capable of limiting the flow rate of rainwater entering the drainage flow pipe, the drainage device comprising:

a drainage head including:

a head portion having a circumferential wall portion at its lowermost end that is sized to encircle the open end of the drainage flow pipe, the head portion defining an interior volume and having at least one orifice placing the interior volume in fluid communication with the exterior of the head portion;

a shoulder attached to, and extending radially inwardly from the lowermost end portion of the circumferential wall portion; and a drainage pipe attached to the shoulder extending away from the head portion and having an outer diameter less than the inner diameter of the drainage flow pipe so that the drainage pipe may be received within the drainage flow pipe;

an attachment sleeve at least partially deformable, secured to the drainage head and capable of fixedly engaging the interior wall of the drainage flow pipe such that the drainage device is securely held in place;

a compression washer attached on the attachment sleeve; and a stressing element movable in relation to the drainage head and capable of axially moving the compression washer to cause outward radial deformation of the attachment sleeve.

2. The drainage device according to claim 1, wherein the stressing element comprises a central screw engaged with the compression washer.

3. The drainage device according to claim 1, wherein the stressing element extends partially inside the drainage head, and connects the drainage head and the compression washer.

4. The drainage device according to claim 1, wherein the stressing element extends axially and is accessible from the outside of the drainage head.

5. The drainage device according to claim 1, wherein the stressing element extends axially protruding in relation to an upper front face of the drainage head.

6. The drainage device according to claim 1, wherein the compression washer is attached to an axial end of the attachment sleeve.

7. The drainage device according to claim 1, wherein the attachment sleeve partially surrounds the drainage pipe.

8. The drainage device according to claim 1, wherein the attachment sleeve has, in a non-deformed state, an external diameter less than the internal diameter of the drainage flow pipe.

9. The drainage device according to claim 1, further comprising a mounting washer attached to the shoulder and by which the attachment sleeve is attached.

10. The drainage device according to claim 1, further comprising a mounting washer attached to an axial end of the attachment sleeve.

11. The drainage device according to claim 1, wherein the attachment sleeve is secured to the drainage pipe.

12. The drainage device according to claim 11, further comprising a seal mounted around the drainage pipe and axially disposed between the shoulder and the attachment sleeve.

13. The drainage device according to claim 12, wherein the seal is axially interposed between the shoulder and the mounting washer.

14. The drainage device according to claim 1, further comprising a perforated cover that surrounds and is spaced from the head portion of the drainage head.

* * * * *